US005665684A

United States Patent [19]

Arai et al.

[11] Patent Number: 5,665,684

[45] Date of Patent: Sep. 9, 1997

[54] LUBRICATING OIL COMPOSITION

[75] Inventors: Katsuya Arai; Satoshi Asano; Sadao Wada, all of Saitama-Ken, Japan

[73] Assignee: Exxon Research and Engineering Company, Florham Park, N.J.

[21] Appl. No.: 553,288

[22] PCT Filed: May 27, 1994

[86] PCT No.: PCT/US94/06001

§ 371 Date: Jan. 3, 1996

§ 102(e) Date: Jan. 3, 1996

[87] PCT Pub. No.: WO94/28094

PCT Pub. Date: Dec. 8, 1994

[30] Foreign Application Priority Data

May 27, 1993 [JP] Japan ..... 5-148669

[51] Int. Cl.[6] ..... C10M 135/18; C10M 141/10

[52] U.S. Cl. ..... 508/365; 508/363; 508/364

[58] Field of Search ..... 508/363, 364, 508/365

[56] References Cited

U.S. PATENT DOCUMENTS

| | | | |
|---|---|---|---|
| 4,171,558 | 10/1979 | Igrashi et al. | 252/42.7 |
| 4,832,867 | 5/1989 | Seiki et al. | 252/42.7 |
| 4,849,123 | 7/1989 | Tipton et al. | 252/42.7 |
| 5,281,347 | 1/1994 | Igayoshi et al. | 252/42.7 |

FOREIGN PATENT DOCUMENTS

| | | |
|---|---|---|
| 0418860A1 | 3/1991 | European Pat. Off. . |
| 59-075995 | 4/1984 | Japan . |
| 62-215697 | 9/1987 | Japan . |
| WO92/19703 | 11/1992 | WIPO . |

*Primary Examiner*—Ellen M. McAvoy
*Attorney, Agent, or Firm*—Joseph J. Allocca

[57] ABSTRACT

A lubricating oil composition containing from 0.01 to 0.8% by weight, based on the whole composition, of a phosphoric ester and/or a phosphorous ester, from 50 to 2,000 ppm (in terms of molybdenum) of sulfurized oxymolybdenum dithiocarbamate having at least one hydrocarbyl group having 8 to 18 carbon atoms and from 0.3 to 2.5% by weight of a calcium salicylate having a total base number of 10 to 100.

5 Claims, No Drawings

LUBRICATING OIL COMPOSITION

BACKGROUND OF THE INVENTION

1. Field of the Invention

The present invention relates to a lubricating oil composition, in particular, a lubricating oil composition having improved friction reducing properties and suitable for use as a lubricating oil for internal combustion engines, automatic transmissions, suspensions and power steering wheels, particularly as a lubricating oil for internal combustion engines.

2. Description of the Related Art

Lubricating oils are usually used for smoothing the working of internal combustion engines, driving mechanisms such as automatic transmissions, suspensions and power stearings, and gears. Particularly, engine oils are effective in lubricating mainly sliding parts such as a piston ring and a cylinder liner, bearings of a crank shaft or a connecting rod, and valve train including cams and valve lifters; in cooling the engine; in cleaning and dispersing combustion products; and in preventing rust formation and corrosion.

Thus, various functions are required for the engine oils and, recently, even better functions are being demanded as the required performance and engine output become higher and higher and the operation conditions more severe. Under these circumstances, additives such as an antiwear agent, metallic detergent, ashless dispersant and antioxidant are incorporated into the engine oil in order to satisfy such requirements.

Since the energy loss in the friction parts in which the lubricating oil participates is high in the engine, the lubricating oil is used in combination with additives such as a friction modifier (FM) in order to minimize the friction loss and improve the fuel consumption (see, for example, Japanese Patent Publication No. 23595/1991). Further, since the engine oil for automobiles is used under the various conditions of oil temperature, engine speed and load, more excellent frictional properties under the wide-range conditions of use are necessitated for further improving the fuel consumption.

The present invention has been completed after investigations made for the purpose of providing a lubricating oil composition having improved friction reducing properties over those of an ordinary lubricating oil containing molybdenum dithiocarbamate and a phosphoric ester, and is suitable for use as a lubricating oil for internal combustion engines, automatic transmissions, suspensions and power steering wheels, particularly as a lubricating oil for internal combustion engines.

SUMMARY OF THE INVENTION

After intensive investigations made for the purpose of developing a lubricating oil composition having improved friction reduction properties, the inventors have found that the above purpose can be attained with a lubricating oil composition containing a specified phosphoric ester and/or phosphorous ester, sulfurized oxymolybdenum dithiocarbamate and a calcium salicylate in specified proportions. The present invention has been completed on the basis of this finding.

Specifically, the present invention provides a lubricating oil composition which comprises a base oil containing (A) from 0.01 to 0.8% by weight, based on the whole composition, of at least one compound selected from the group consisting of (a) phosphoric esters of the general formula:

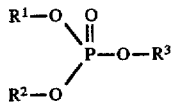

[1]

wherein $R^1$, $R^2$ and $R^3$ may be the same or different and each represents a hydrogen atom or a hydrocarbyl group having 3 to 23 carbon atoms, with the proviso that at least one of $R^1$ to $R^3$ is a hydrocarbyl group having 3 to 23 carbon atoms, and (b) phosphorous esters of the general formula:

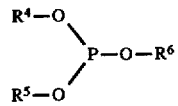

[2]

wherein $R^4$, $R^5$ and $R^6$ may be the same or different and each represents a hydrogen atom or a hydrocarbyl group having 3 to 23 carbon atoms, with the proviso that at least one of $R^4$ to $R^6$ is a hydrocarbyl group having 3 to 23 carbon atoms;

(B) from 50 to 2,000 ppm in terms of molybdenum, of sulfurized oxymolybdenum dithiocarbamate having at least one hydrocarbyl group having 8 to 18 carbon atoms; and (C) from 0.3 to 2.5% by weight, based on the whole composition of a calcium salicylate having a total base number of 10 to 100.

DETAILED DESCRIPTION OF THE INVENTION

The base oil usable as the major component in the lubricating oil composition of the present invention is not particularly limited. Base oils are those usually used in ordinary lubricating oils, such as mineral oils and synthetic oils.

The mineral oils include, for example, 60 neutral oil, 100 neutral oil, 150 neutral oil, 300 neutral oil and 500 neutral oil obtained by solvent refining or hydrorefining; and low-pour point base oils prepared by removing a wax from these base oils so as to improve the low-temperature fluidity. They may be used either singly or in the form of a mixture of two or more of them in a proper ratio.

The synthetic oils include, for example, poly-α olefin oligomers, diesters, polyol esters and polyglycol esters. They are usable either singly or in the form of a mixture. They are also usable in the form of a mixture with the above-described mineral oil. The blending weight ratio of the synthetic oil to the mineral oil is, for example, 80:20 to 20:80.

A suitable base oil usable in the composition of the present invention is one having a viscosity in the range of 3 to 20 cSt at 100° C. Particularly preferred are hydrocracked products and/or wax isomerized products containing 3.0% by weight or below of an aromatic component and having a sulfur content of 50 ppm or below and a nitrogen content of 50 ppm below.

In the composition of the present invention, the component (A) is at least one compound selected from the group consisting of a (a) phosphoric ester of the general formula:

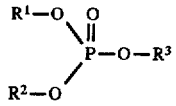

[1]

wherein $R^1$, $R^2$ and $R^3$ are each as defined above, and (b) phosphorous esters of the general formula:

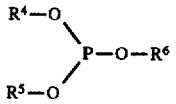

[2]

wherein $R^4$, $R^5$ and $R^6$ are each as defined above.

The groups $R^1$, $R^2$ and $R^3$ in the above general formula [1] may be the same or different and each represents a hydrogen atom or a hydrocarbyl group having 3 to 23 carbon atoms, with the proviso that at least one of $R^1$ to $R^3$ is the hydrocarbyl group having 3 to 23 carbon atoms. The hydrocarbyl groups having 3 to 23 carbon atoms include linear, branched and cyclic alkyl and alkenyl groups having 3 to 23 carbon atoms, aryl groups having 6 to 23 carbon atoms, alkylaryl groups having 7 to 23 carbon atoms and arylalkyl groups having 7 to 23 carbon atoms. Examples include propyl, butyl, pentyl, hexyl, cyclohexyl, octyl, decyl, lauryl, myristyl, palmityl, stearyl, oleyl, eicosyl, phenyl, xylyl, benzyl and phenethyl groups.

The groups $R^4$, $R^5$ and $R^6$ in the above general formula [2] for the phosphorous esters may be the same or different and each represents a hydrogen atom or a hydrocarbyl group having 3 to 23 carbon atoms, with the proviso that at least one of $R^4$ to $R^6$ is a hydrocarbyl group having 3 to 23 carbon atoms. Examples include those mentioned above with reference to $R^1$, $R^2$ and $R^3$ in the above general formula [1].

The composition of the present invention may contain phosphoric esters either singly or in combination of two or more of them and/or the phosphorous esters either singly or in combination of two or more of them as the component (A). Further, a combination of one or more of the phosphoric esters with one or more of the phosphorous esters may be also used.

The composition of the present invention must contain the phosphoric ester and/or phosphorus ester as the component (A) in an amount of 0.01 to 0.8% by weight, preferably 0.05 to 0.5% by weight, based on the whole composition. When the amount of (A) is below 0.01% by weight, no sufficiently low frictional properties can be obtained and, when it exceeds 0.8% by weight, there is no significant further improvement in frictional properties.

The sulfurized oxymolybdenum dithiocarbamates (MoDTC) which contain at least one hydrocarbyl group having 8 to 18 carbon atoms are used as component (B). MoDTC has a structure represented by the following general formula:

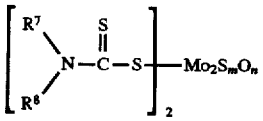

[3]

The groups $R^7$ and $R^8$ in the above general formula [3] each represent a hydrocarbyl group having 8 to 18 carbon atoms. The hydrocarbyl groups having 8 to 18 carbon atoms include linear and branched alkyl and alkenyl groups having 8 to 18 carbon atoms, and cycloalkyl, aryl, alkylaryl and arylalkyl groups having 8 to 18 carbon atoms. Examples include 2-ethylhexyl, n-octyl, nonyl, decyl, lauryl, tridecyl, palmityl, stearyl, oleyl, eicosyl, butylphenyl and nonylphenyl groups. $R^7$ and Ry may be the same or different from each other. m and n are positive integers such that the sum of m+n is 4.

In the composition of the present invention, the MoDTC used as component (B) may be used singly or as a combination of two or more of them. The amount of MoDTC is in the range of 50 to 2,000 ppm, preferably 100 to 1,000 ppm (in terms of molybdenum) based on the whole composition. When the amount of molybdenum is below 50 ppm, no sufficient friction reduction properties can be obtained and when it is above 2,000 ppm, there is no further significant improvement in the frictional properties.

A calcium salicylate having a total base number of 10 to 100 is used as the component (C) in the composition of the present invention. The calcium salicylate is, for example, one represented by the following general formula:

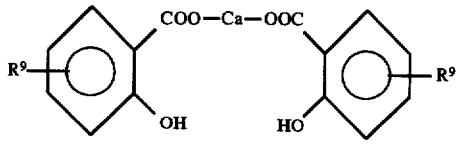

[4]

The group $R^9$ in the general formula [4] represents a linear, branched or cyclic alkyl group having 8 to 23 carbon atoms, such as an octyl, nonyl, decyl, dodecyl, pentadecyl, octadecyl or eicosyl group.

The calcium salicylate used as component (C) may be used either singly or in combination of two or more of them. The amount of the calcium salicylate is in the range of 0.3 to 2.5% by weight based on the whole composition. When the amount of (C) is below 0.3% by weight, no sufficient low frictional properties can be obtained and, when the amount exceeds 2.5% by weight, the wear resistance is reduced and the ash content is increased unfavorably.

The lubricating oil composition of the present invention may contain suitable additives usually incorporated into lubricating oils, such as an ashless detergent-dispersant, viscosity index improver, pour point depressant, antioxidant, rust inhibitor, corrosion inhibitor, antifoaming agent and other antiwear agent and friction modifier, so far as the object of the present invention is not disturbed.

The ashless detergent-dispersants include, for example, succinimides, succinamides, benzylamines, their boron derivatives and esters. They are used in an amount of usually 0.5 to 7% by weight, based on the whole composition.

The viscosity index improvers include, for example, polymethacrylates, polyisobutylenes, ethylene/propylene copolymers and hydrogenated styrene/butadiene copolymers. They are used in an amount of from 0.5 to 35% by weight, based on the whole composition. The anti-oxidants include, for example, amine antioxidants such as alkylated diphenylamines, phenyl-α-naphthylamines and alkylated α-naphthylamines, and phenolic antioxidants such as 2,6-di-t-butyl-4-methyl-phenol and 4,4'-methylenebis(2,6-di-t-butyl-4-methyl-phenol and 4,4'-methylenebis(2,6-di-t-butylphenyl). They are used in an amount of usually 0.05 to 2% by weight, based on the whole composition.

The rust inhibitors include, for example, alkenylsuccinic acids and partial esters thereof. The corrosion inhibitors include, for example, benzotriazole and benzimidazole. The antifoaming agents include, for example, dimethylpolysiloxanes and polyacrylates. They can be suitably incorporated into the oil composition.

The following Examples further illustrate the present invention and do not limit the invention.

EXAMPLES 1 TO 8 AND COMPARATIVE EXAMPLES 1 TO 5

The coefficient of friction of the lubricating oil composition was determined as follows:

(1) Coefficient of friction (μ):

The coefficient of friction was determined by the LFW-1 test under the conditions of 270 rpm, 30 kgf, 120° C. and 10 minutes.

Base oil 150N-1 (having viscosity at 100° C. of 5.7 $mm^2/s$, aromatic component content of 4.1 wt %, sulfur content of 11.0 ppm and nitrogen content of 89.0 ppm) or 150N-2 (having viscosity at 100° C. of 5.5 $mm^2/s$, aromatic component content of 0.5 wt %, sulfur content of 0.5 ppm and nitrogen content of 0.1 ppm) was used.

Each of the lubricating oil compositions listed in Table was prepared from the base oil, and the coefficient of friction (μ) thereof was determined. The results are given in Tables 1-1 and 1-2.

TABLE 1-1

| | | Example 1 | Example 2 | Example 3 | Example 4 | Example 5 | Example 6 | Example 7 | Example 8 |
|---|---|---|---|---|---|---|---|---|---|
| Component (wt %) | Base Oil 150N-1 | balance | balance | balance | balance | balance | — | — | — |
| | Base Oil 150N-2 | — | — | — | — | — | balance | balance | balance |
| | Ca salicylate (TBN70) | 0.5 | 1.2 | 2.5 | 2.5 | 2.5 | 2.5 | 2.5 | 2.5 |
| | $C_8$—MoDTC (Mo = 500 ppm) | 1.0 | 1.0 | — | — | 1.0 | 1.0 | — | — |
| | $C_{16}$—MoDTC (Mo = 500 ppm) | — | — | 1.0 | 1.0 | — | — | 1.0 | 1.0 |
| | phosphoric ester(1) | 0.1 | 0.1 | 0.1 | 0.3 | 0.3 | 0.1 | 0.3 | 0.3(2) |
| Evaluation | coefficient of friction (μ) | 0.040 | 0.033 | 0.039 | 0.036 | 0.039 | 0.029 | 0.027 | 0.030 |

Notes:

(1)phosphoric ester:

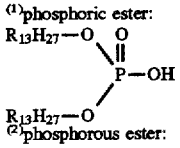

(2)phosphorous ester:

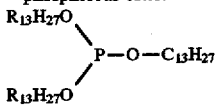

TABLE 1-2

| | | Comparative Example 1 | Comparative Example 2 | Comparative Example 3 | Comparative Example 4 | Comparative Example 5 |
|---|---|---|---|---|---|---|
| Component (wt %) | Base Oil 150N-1 | balance | balance | balance | — | — |
| | Base Oil 150N-2 | — | — | — | balance | balance |
| | Ca salicylate (TBN70) | 0.5 | — | 2.5 | 0.5 | 0.25 |
| | $C_8$—MoDTC (Mo = 500 ppm) | 1.0 | — | — | 1.0 | — |
| | $C_{18}$—MoDTC (Mo = 500 ppm) | — | 0.1 | — | — | — |
| | phosphoric ester(1) | — | 0.1 | 0.1 | — | 0.3 |
| Evaluation | coefficient of friction (μ) | 0.060 | 0.053 | 0.073 | 0.046 | 0.069 |

Note:

(1)phosphoric ester:

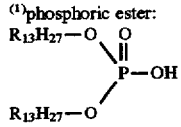

As demonstrated by Examples 1–8 in Table 1-1, and comparative Examples 1–5 in Table 1-2, a lubricating oil containing the combination of salicylate, MoDTC and phosphoric ester according to the invention provides a significantly lower coefficient of friction over an oil composition containing any two components.

The lubricating oil composition of the present invention has superior low frictional properties to those of ordinary lubricating oils comprising MoDTC and a phosphoric ester, and is suitable for use as a lubricating oil for, for example, internal combustion engines, automatic transmissions, suspensions and power steering wheels, particularly as a lubricating oil for internal combustion engines.

We claim:

1. A lubricating oil composition which comprises a base oil containing:

(A) from 0.01 to 0.8 wt %, based on the whole composition, of at least one compound selected from the group consisting of:

(a) phosphoric esters of the general formula

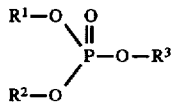

wherein $R^1$, $R^2$ and $R^3$ may be the same or different and each represents a hydrogen atom or a hydrocarbyl group having 3 to 23 carbon atoms, with the proviso that at least one of $R^1$ to $R^3$ is a hydrocarbyl group having 3 to 23 carbon atoms, and (b) phosphorous esters of the general formula:

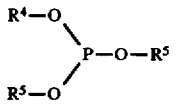

wherein $R^4$, $R^5$ and $R^6$ may be the same or different and each represents a hydrogen atom or a hydrocarbyl group having 3 to 23 carbon atoms, with the proviso that at least one of $R^4$ to $R^6$ is a hydrocarbyl group having 3 to 23 carbon atoms;

(B) from 50 to 2,000 ppm in terms of molybdenum, based on the whole composition of sulfurized oxymolybdenum dithiocarbamate having at least one hydrocarbyl group having 8 to 18 carbon atoms, and (C) from 0.3 to 2.5% by weight, based on the whole composition, of a calcium salicylate having a total base number of 10 to 100.

2. The oil composition of claim 1 wherein the base oil is a hydrocracked product and/or a wax isomerized product containing 3.0% by weight based on base oil or below of an aromatic component and having a sulfur content of 50 ppm or below and a nitrogen content of 50 ppm or below.

3. The oil composition of claim 1 wherein the amount of component (A) is from 0.05 to 0.5% by weight, based on whole composition.

4. The oil composition of claim 1 wherein the sulfurized oxymolybdenum dithiocarbamate has the formula:

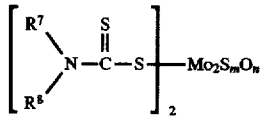

where $R^7$ and $R^8$ are each independently a hydrocarbyl group having 8 to 18 carbon atoms and the sum of m+n is 4.

5. The oil composition of claim 1 wherein the calcium salicylate has the formula:

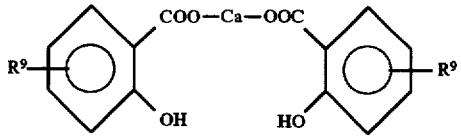

where $R^9$ is a linear, branched or cyclic alkyl group having 8 to 23 carbon atoms.

* * * * *